US008360789B2

(12) United States Patent
Yin et al.

(10) Patent No.: US 8,360,789 B2
(45) Date of Patent: Jan. 29, 2013

(54) INTERCONNECTION SYSTEM FOR ELECTRONICS CARDS

(75) Inventors: Leo Yin, Shanghai (CN); Marnix Van Der Mee, Montlouis sur Loire (FR); Fabrice Bernard, Shanghai (CN)

(73) Assignee: Radiall, Rosny Sous Bois (FR)

( * ) Notice: Subject to any disclaimer, the term of this patent is extended or adjusted under 35 U.S.C. 154(b) by 0 days.

(21) Appl. No.: 13/274,866

(22) Filed: Oct. 17, 2011

(65) Prior Publication Data

US 2012/0094526 A1 Apr. 19, 2012

(30) Foreign Application Priority Data

Oct. 19, 2010 (FR) ..... 10 58535

(51) Int. Cl.
*H01R 12/00* (2006.01)

(52) U.S. Cl. ..... 439/66

(58) Field of Classification Search ..... 439/65, 439/66, 74, 591, 352
See application file for complete search history.

(56) References Cited

U.S. PATENT DOCUMENTS

| | | | | |
|---|---|---|---|---|
| 5,069,627 | A * | 12/1991 | Buck et al. | 439/66 |
| 5,520,545 | A * | 5/1996 | Sipe | 439/65 |
| 6,231,352 | B1 | 5/2001 | Gonzales | |
| 6,457,980 | B2 * | 10/2002 | Hattori et al. | 439/74 |
| 6,695,622 | B2 * | 2/2004 | Korsunsky et al. | 439/65 |
| 6,814,620 | B1 * | 11/2004 | Wu | 439/607.08 |
| 6,918,774 | B2 * | 7/2005 | Wu | 439/65 |
| 7,338,291 | B2 * | 3/2008 | Takada | 439/65 |
| 7,445,467 | B1 * | 11/2008 | Matsuo | 439/74 |
| 7,651,338 | B2 * | 1/2010 | Miyamoto et al. | 439/66 |
| 2001/0049231 | A1 * | 12/2001 | Bricaud | 439/630 |
| 2004/0072472 | A1 | 4/2004 | Barry et al. | |
| 2008/0220630 | A1 | 9/2008 | Sipe et al. | |
| 2008/0242161 | A1 | 10/2008 | Takada et al. | |
| 2009/0186495 | A1 | 7/2009 | Taylor | |

FOREIGN PATENT DOCUMENTS

EP 0 793 299 A1 9/1997

OTHER PUBLICATIONS

French Search Report issued in French Patent Application No. 1058535 dated May 2, 2011 (with translation).

* cited by examiner

*Primary Examiner* — Chandrika Prasad
(74) *Attorney, Agent, or Firm* — Oliff & Berridge, PLC

(57) ABSTRACT

The present invention relates to an interconnection system for connecting two electronics cards together, wherein the system includes first and second subassemblies including housings each receiving at least one connector, the first and second subassemblies being configured for fastening to first and second electronics cards respectively; and a coupling, third subassembly including housings receiving connector couplings, said connector couplings being configured to couple the connectors of the first subassembly with the connectors of the second subassembly; the third subassembly being configured to be placed between the first and second subassemblies.

18 Claims, 7 Drawing Sheets

Fig.13
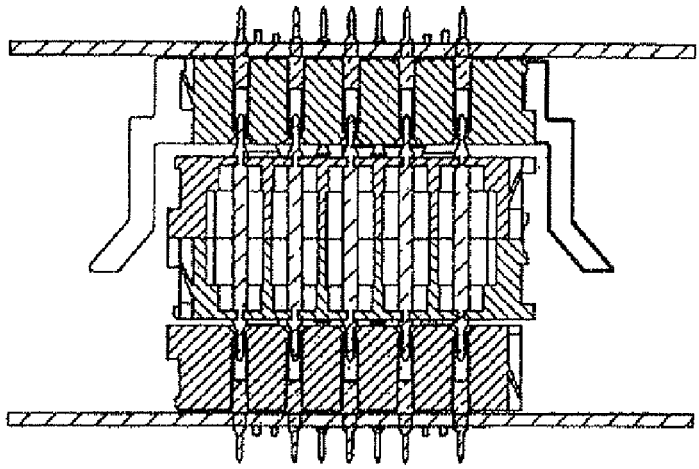
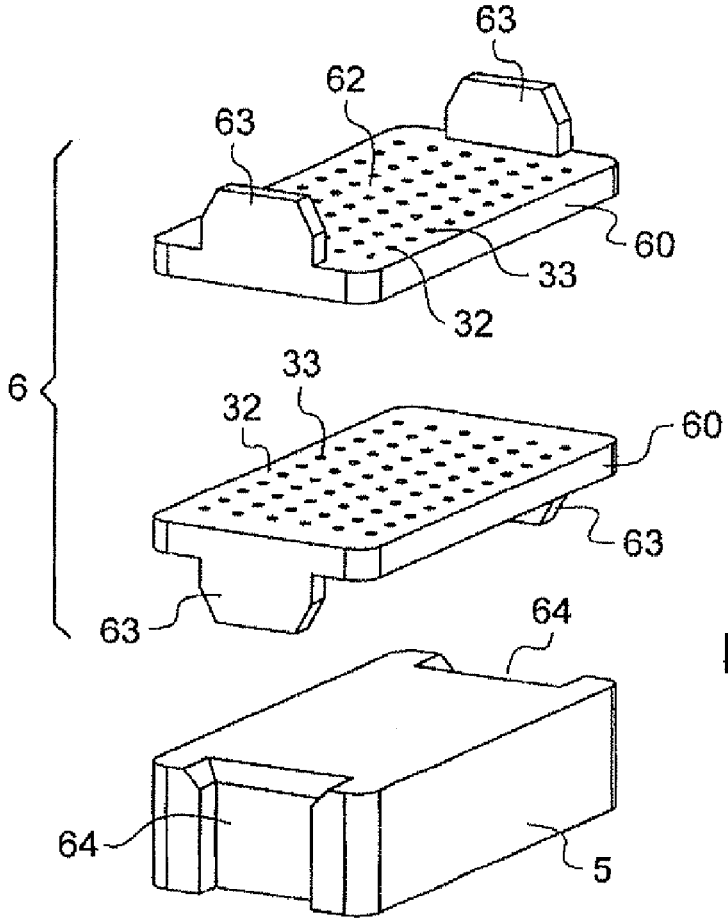
Fig.14

INTERCONNECTION SYSTEM FOR ELECTRONICS CARDS

FIELD OF THE INVENTION

The present invention relates to an interconnection system for connecting two electronics cards together. By way of example, the invention applies to interconnecting pieces of equipment for telecommunications, medical hardware, or more generally any electronic equipment, such pieces of equipment possessing electronics cards that are arranged in particular parallel to each other.

BACKGROUND OF THE INVENTION

Interconnecting such electronics cards involves taking account of static interdeterminancy. Static interdeterminancy results for example from the method used for interconnecting electronics cards, from the need to provide peripheral shielding around the electronics cards as connected together in this way, from the need for the resulting assembly to be robust, and/or from the large number of interconnections that are to be made.

By way of example, U.S. Pat. No. 6,231,352 in the name of the Applicant discloses an interconnection system for connecting electronics cards together, said system comprising a connector arranged between the two cards and rigidly fastened at a first end to one of the cards and possessing tabs at a second end opposite from the first end, which tabs are configured to bear against the second card.

Such a system is limited to providing a coaxial connection between two electronics cards. Unfortunately, new ranges of electronics equipment require compact solutions incorporating a plurality of connectors of different kinds, for example coaxial connectors and signal connectors, in particular radiofrequency (RF) or indeed optoelectronic connectors.

Furthermore, the connector of U.S. Pat. No. 6,231,352 is not completely satisfactory in combating alignment defects that occur when the two electronics cards are interconnected. It can be desirable to have an interconnection system that makes it possible to compensate for alignment defects between one electronics card and the other in two or even three dimensions so as to enable the electronics cards to be interconnected.

OBJECT AND SUMMARY OF THE INVENTION

An object of the invention is to provide an interconnection system for connecting two electronics cards together that is adapted to a large number of different types of connector, i.e. both to coaxial connectors and to signal connectors, and that enables two cards to be connected together in a manner that is simple, effective, and robust.

Exemplary embodiments of the invention thus provide an interconnection system for connecting two electronics cards together, in particular two electronics cards arranged in parallel, wherein the system comprises:

- first and second subassemblies including housings each receiving at least one connector, the first and second subassemblies being configured for fastening to first and second electronics cards respectively; and
- a coupling, third subassembly including housings receiving connector couplings, said connector couplings being configured to couple the connectors of the first subassembly with the connectors of the second subassembly;

the third subassembly being configured to be placed between the first and second subassemblies.

By means of its coupling subassembly, such an interconnection system is capable of accommodating alignment defects of various kinds between the electronics cards, e.g. defects in axial and/or angular alignment.

When the two cards that are to be interconnected are parallel, the term "height" is used to designate the distance measured in a direction perpendicular to the planes in which said cards extend.

Below, the system is said to be "assembled" when the electronics cards are interconnected.

The first and second subassemblies may be boxes.

In a variant, only the first and second subassemblies are boxes, the third subassembly not being a box.

The connectors may be held releasably in the housings of the first and second subassemblies, e.g. by snap-fastening.

The connectors arranged in the subassemblies may comprise connectors of two different types, in particular coaxial connectors, e.g. coaxial receptacles, and signal connectors. These two different types may be selected, for example, from coaxial connectors, RF connectors, and optoelectronic connectors. The term "connector" is used below also to cover signal contacts, in particular RF contacts, optoelectronic contacts, . . . .

The connectors may also be shielded connector pairs configured to convey analog or digital electric signals at low or high frequency. The connectors may also be configured for electrically powering the electronics cards.

The ends of the connectors of the first subassembly arranged facing the third subassembly during assembly may be of the same type as the ends of the connectors of the second subassembly arranged facing the third subassembly during assembly, said ends comprising for example male type ends only. In a variant, said ends may be female type ends only. In another variant, the ends of the connectors of the first subassembly placed facing the third subassembly during assembly of the system are of a type different from the ends of the connectors of the second subassembly placed facing the third subassembly during assembly, in particular, the ends of one being of the male type and the ends of the other of the female type, or vice versa.

The two ends of each connector coupling may be of the same type, e.g. male. In a variant, each coupling may possess two ends of female type. In another variant, each coupling may possess one end of male type and another end of female type. In other examples, the third subassembly may receive couplings having both ends of male type, couplings having both ends of female type, and/or couplings in which the end facing the first subassembly is of male type and the end facing the second subassembly is of female type.

The invention thus makes it possible to provide an interconnection system for interconnecting two electronics cards and involving different kinds of signal.

Advantageously, at least one of the first, second, and third subassemblies includes at least one guide arm configured to come into contact with another one of the first, second, and third subassemblies during assembly of the interconnection system. Such guide structures may make it easier to center a subassembly relative to the others, and thus make it easier to assemble the system.

The third subassembly may include guide and/or attachment means for engaging at least one of the first and second subassemblies. The presence of such attachment means, which may project from the third subassembly towards the first or second subassembly, may protect male type ends of the connector couplings received in the third subassembly.

In a variant, the first or second subassembly includes such means for attaching to the third subassembly, the third subassembly including only guide means for providing guidance relative to the first or second subassembly.

Advantageously, the first, second, and third subassemblies comprise respective pluralities of units configured to be releasably assembled together in order to form the first, second, and third subassemblies respectively. The invention thus makes it possible to obtain a highly modular interconnection system, with it being possible to assemble together a large number of units to form the subassemblies. It is thus possible to vary the number of connectors interconnecting the two electronics cards as a function of utilization.

By way of example, the releasable fastening between the units in order to constitute the first, second, or third subassembly may be implemented by co-operation between complementary portions in relief carried by said units, in particular ribs and grooves, and/or by actuatable snap-fastener means such as snap-fastener tabs.

At least one unit, and in particular each of the units, may include two to two hundred housings, or indeed two to four hundred housings.

The first, second, and third subassemblies may include at least one respective unit that has housings for receiving connectors of one type only, e.g. coaxial connectors, and at least one other unit including housings for receiving only connectors of another type, e.g. signal connectors.

In a variant, one unit includes housings receiving connectors of a first type and another unit includes housings receiving connectors of a first type and housings receiving connectors of a second type that is different from the first type, the connectors of the first type being coaxial connectors, for example, and the connectors of the second type being signal connectors, for example.

In another variant, a subassembly may be constituted by units of different sizes, in particular units presenting different numbers of housings, said units receiving only connectors of the same type.

In another variant, a subassembly may be constituted by at least one unit including housings receiving connectors of a first type only, at least one unit including housings receiving connectors of a second type only, and at least one unit including housings receiving connectors of the first and second types.

The third subassembly may include at least one unit comprising two shells of complementary shapes, e.g. two half-shells, that, when assembled together, define between them the housings receiving the connector couplings, each of said housings being opened at two opposite ends defined by openings in the wall of each shell.

The use of two half-shells or of two same-shape shells may make it possible to use a single mold for making such shells by molding, thereby enabling fabrication costs to be reduced.

In a variant, the first subassembly has two shells, each designed to be fitted on a respective one of the first and second subassemblies. By way of example, each shell includes attachment means for attaching to one of the first and second subassemblies. When each shell of the third subassembly is fitted to one of the first and second subassemblies and the system is assembled, said shells need not come into contact with each other. Each shell may extend over only a fraction of the height of the third subassembly.

Thus, the shells may facilitate tilting of the connector couplings in the third subassembly in order to accommodate alignment defects between the electronics cards.

The shell(s) of the third subassembly fitted to the first subassembly and the shell(s) of the third subassembly fitted to the second subassembly may be connected to one another solely via the connector couplings when the system is assembled. With such a third subassembly, the system may be used for interconnecting electronics cards that are spaced apart by different distances. Under such circumstances, it is only the length of the connector couplings of the third subassembly that depend on the distance between the two electronics cards, so it is only said length of the connector couplings that needs to be modified. The same shells can thus be used for making the third subassembly of an interconnection system regardless of the distance between the cards that are to be interconnected.

In a variant, the third subassembly may include connection means for connecting the shell(s) fitted to the first subassembly to the shell(s) fitted to the second subassembly. The connection means may optionally be configured to be elastically deformable, so as to enable them to adapt to different distances between the electronics cards. By way of example, the connection means may be made of rubber. Said connection means may serve to keep the shells in a neutral position, i.e. in a position in which the connector couplings are received at right angles in each shell, without being in a tilted position.

In the two above variants, the third subassembly constitutes a single item once each shell has been put into place on the first or second subassembly, respectively, and the system has been assembled.

The attachment means of a shell of the third subassembly for attachment to the first or second subassembly may be configured in such a manner that the facing surfaces of a shell and the first or second subassembly to which the shell is attached are not in contact, with clearance being provided between the facing surfaces in a direction that is substantially perpendicular to the planes in which the electronics cards extend. This clearance may lie in the range 0 to 10 millimeters (mm), e.g. being less than 3 mm. The presence of such clearance may serve to accommodate construction tolerances for all or some of the components of the interconnection system in a direction perpendicular to the planes in which the electronics cards extend.

Furthermore, each shell and the first and/or second subassemblies may be configured in such a manner that when a shell is attached to the first or second subassembly, a portion of the shell is placed around a portion of the first or second subassembly with clearance in a direction parallel to the planes in which the electronics cards extend. By way of example, this clearance may lie in the range 0 to 2 mm and may allow the connector couplings carried by the shell to tilt relative to the first or second subassembly, this clearance serving to accommodate an alignment defect between the planes in which the electronics cards extend.

At least one connector coupling and at least one unit of the third subassembly may include means configured to hold said coupling in a housing, in non-releasable manner. The connector couplings may thus be held captive in the third subassembly, the third subassembly then forming a single structure.

By way of example, the means for holding the connector coupling in the housing may comprise at least one portion in relief, in particular an annular groove, formed in the outside surface of the coupling, together with tabs formed in the wall of a shell in register with at least one opening forming an end of the housing. By way of example, each coupling may include such a portion in relief, in particular such a groove, in the proximity of each of its two ends, and each opening forming an end of each housing is surrounded by such tabs.

The tabs may be regularly distributed around the opening. By way of example, the tabs are separated from one another in pairs by slots, said slots forming a star pattern when the third subassembly is seen from above. Advantageously, such tabs are configured to deform during insertion of the couplings in the third subassembly so as to enable the couplings to be mounted in the third subassembly in a manner that is easy and non-separable.

In a variant, each opening forming an end of each housing need not be provided with tabs, but rather may be provided with a lip, e.g. made by thinning the material of the shell, the lip projecting into the housing and serving to hold the connector coupling that is received in said housing.

In a variant or in combination with the above examples of holder means, each housing formed in the third subassembly may include in the proximity of at least one of its openings a portion having an inside surface that is conical, and each connector coupling may include a portion having an outside surface that is spherical, with co-operation between these spherical and conical surfaces enabling the connector couplings to be received in controlled manner in the housings formed in the third subassembly, the third subassembly also including means for connecting together the above-mentioned shells.

Each housing in the first or second subassembly may include an end for facing the third subassembly when the interconnection system is assembled, at least one of said housings including an end portion extending from said end of the housing towards the inside of said first or second subassembly and presenting a cross-section that tapers going away from said end. By way of example, the end portion may be funnel-shaped, thereby serving to guide the connector couplings of the third subassembly into the housings of the first and/or second subassembly.

The connectors and/or connector couplings may be generally tubular in shape, e.g. being straight connectors, i.e. connectors that are not angled.

The various units and/or shells mentioned above may be made out of plastics material(s) or any other electrically insulating material.

Other exemplary embodiments of the invention also provide a method of interconnecting two electronics cards using a system as defined above, wherein the method comprises the following steps:

- fastening the first and second subassemblies to the first and second electronics cards, respectively;
- assembling the third subassembly to one of the first and second subassemblies; and
- assembling the assembly that is obtained at the end of the preceding step to the other one of the first and second subassemblies.

When the connectors comprise coaxial connectors and signal connectors, a plurality of pre-centering operations may be performed while implementing the above method. A first operation of pre-centering the various subassemblies relative to one another may be provided by the guide arm(s), for example.

A second pre-centering operation may be enabled by co-operation between the coaxial connector couplings arranged in the third subassembly and the end portions of the housings in the first and/or second subassembly when the coaxial couplings come into contact therewith.

A third pre-centering operation may be enabled by co-operation between the signal connector couplings arranged in the third subassembly and end portions of the housings of the first and/or second subassemblies when the signal connector couplings come into contact therewith.

BRIEF DESCRIPTION OF THE DRAWINGS

The invention can be better understood on reading the following description of non-limiting embodiments thereof and on examining the accompanying drawings, in which:

FIG. 13 is a section view of an example of an interconnection system after assembly;

FIG. 14 is an elevation view of second and third subassemblies in another embodiment of the invention;

MORE DETAILED DESCRIPTION

Figure 1:
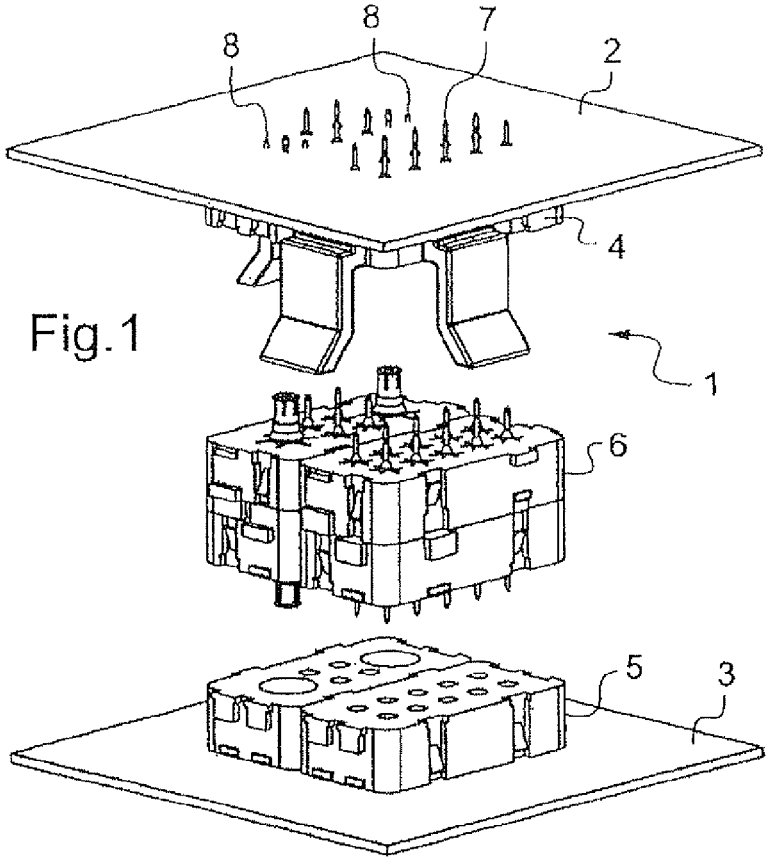
FIG. 1 is a view of an interconnection system in a first embodiment of the invention prior to assembly.

FIG. 1 shows an interconnection system given overall reference 1 serving to interconnect two electronics cards 2 and 3. These electronics cards 2 and 3 are constituted, for example, by cards that are used in telecommunications equipment, medical hardware, etc. By way of example, these cards present a width lying in the range 10 mm to 1000 mm and a length lying in the range 10 mm to 1000 mm. As can be seen, a first subassembly given overall reference 4 is fastened on the card 2 and a second subassembly given overall reference 5 is fastened on the card 3. In the example shown, the system 1 also includes a third subassembly, also referred to as a "coupling" subassembly, that is given overall reference 6 and that is configured to be placed between the first subassembly 4 and the second subassembly 5 when the interconnection system 1 is assembled.

As can be seen in FIG. 1, the system 1 serves to interconnect connectors of a single type, or in a variant connectors 7 and 8 of different types between the electronics cards 2 and 3. These connectors 7 or 8 may project beyond the cards 2 and 3 when they are placed in the first subassembly 4 and in the second subassembly 5, and when these subassemblies 4 and 5 are fastened to the cards 2 and 3.

As can be seen in FIG. 1, each of the subassemblies 4, 5, or 6 may be made up of a plurality of units, these units including housings that, for the subassemblies 4 and 5, serve to receive connectors, and for the subassembly 6 serves to receive connector couplings, as described below. In a variant that is not shown, the subassemblies 4, 5, and 6 comprise respective single pieces, i.e. they are not themselves formed by assembling a plurality of units together.

In the examples shown, the subassemblies 4, 5, and 6 form boxes, but the invention is not limited to such an example.

Figure 2:
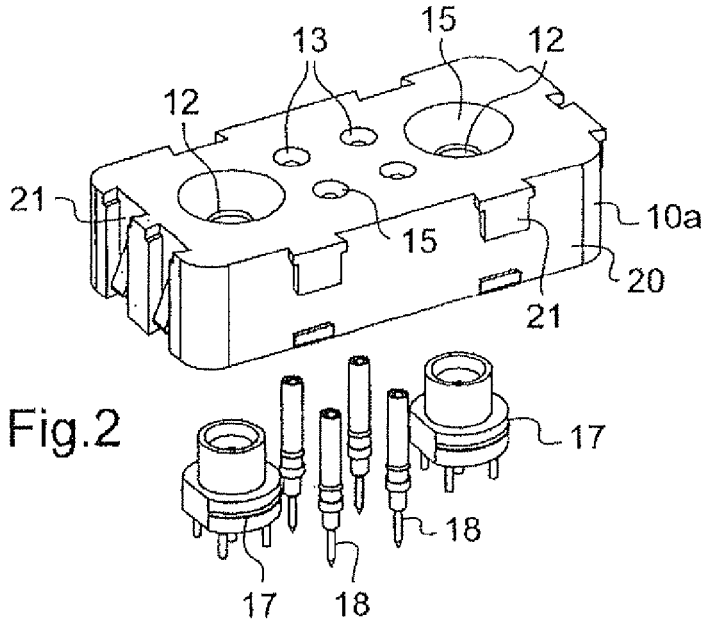
FIG. 2 shows a first example of a unit of the first or second subassembly of FIG. 1.
Figure 3:
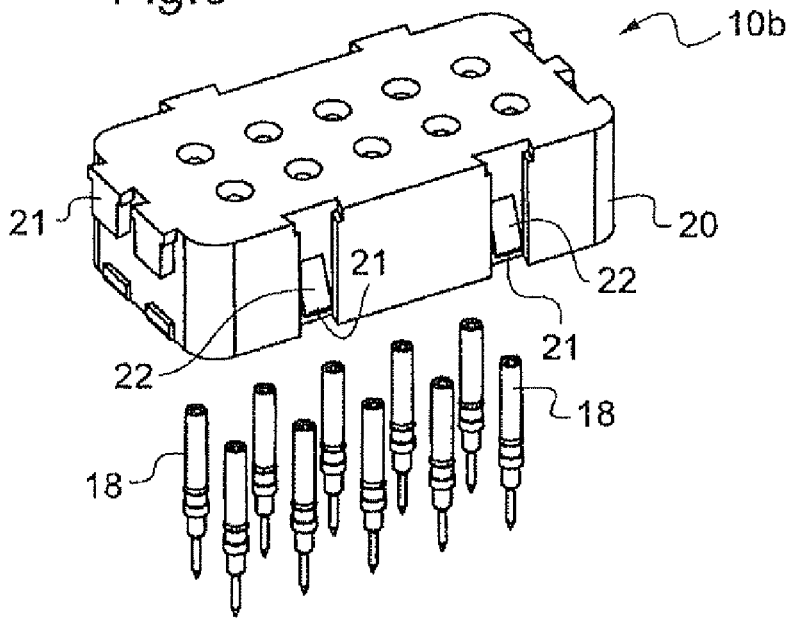
FIG. 3 shows a second example of a unit of the first or second subassembly of FIG. 1.

FIGS. 2 and 3 show units of a first or second subassembly in greater detail. In the example under consideration, a subassembly is made up of two types of unit 10*a*and 10*b*, however the invention is not limited to any particular number of different types of unit. In the examples shown, each unit 10*a* or 10*b* presents a shape that is generally rectangular.

The unit 10*a* shown in FIG. 2 includes housings of two different types, given respective references 12 and 13. The housings 12 and 13 are through housings in the example under consideration. In FIG. 2, it can be seen that the housings 12 present a cross section that is greater than the cross section of the housings 13, the housings 12 being configured to receive connectors of a type that is different from that of the connectors received in the housings 13. In the example under consideration, the unit 10*a* has more housings 13 than it has housings 12, but the invention is not limited to any particular ratio between the number of housings 12 and the number of housings 13.

As shown in FIG. 2, the housings 12 and 13 have end portions 15 opening to the outside of the unit 10*a*. As can be seen in FIG. 2, such an end portion 15 may present a cross-section that increases on approaching the outside of the unit 10*a*. This increase in cross-section of the end portion 15 may be continuous or otherwise. In the example described, the end portion 15*a* is funnel-shaped, for example.

FIG. 2 also shows connectors configured to be arranged in the housings provided in the unit 10*a*. By way of example, each connector is held in a housing by snap-fastening. In the example under consideration, the connectors comprise coaxial connectors 17, here coaxial receptacles, and signal connectors 18, with the signal connectors 18 being RF connectors or indeed optoelectronic connectors, for example.

As shown in FIG. 2, the side surface 20 of the unit 10*a* may present portions in relief 21, these portions in relief 21 being constituted for example by grooves and ribs that are configured to co-operate with complementary portions in relief 21 of other units 10*a* or 10*b* in order to form a subassembly 4 or 5. In the example of FIG. 2, the side surface 20 is made up of four side faces, and each of these faces carries portions in relief 21. Two opposite side faces may carry complementary portions in relief, one of said faces carrying ribs and the other one of said faces carrying grooves. A snap-fastener tab 22 may be provided in each groove 21.

FIG. 3 shows another example of a unit 10*b* that differs from that shown in FIG. 2 by the fact that it has housings 13 of only one type, these housings 13 being configured to receive only signal connectors 18, for example.

A total of six housings are formed in the unit 10*a* of FIG. 2, whereas a total of ten housings are formed in the unit 10*b* of FIG. 3. By way of example, the number of housings per unit 10*a* or 10*b* may lie in the range two to two hundred or even two to four hundred.

With reference to FIGS. 4 to 7, there follows a description of the steps in assembling the units 10*a* and 10*b* in order to form the first subassembly 4 or the second subassembly 5 of the interconnection system 1. These units may be releasably assembled, in particular by means of the portions in relief 21 carried on the side surfaces 20 of the units 10*a* and 10*b* being of complementary shapes.

Figure 4:
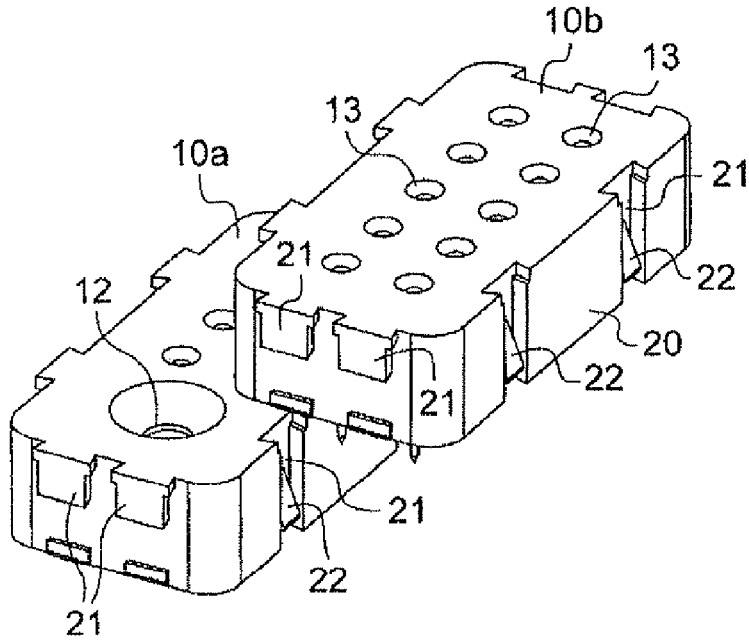
FIGS. 4 and 5 are views from different directions showing a step during the fastening of a FIG. 2 unit to a FIG. 3 unit.
Figure 5:
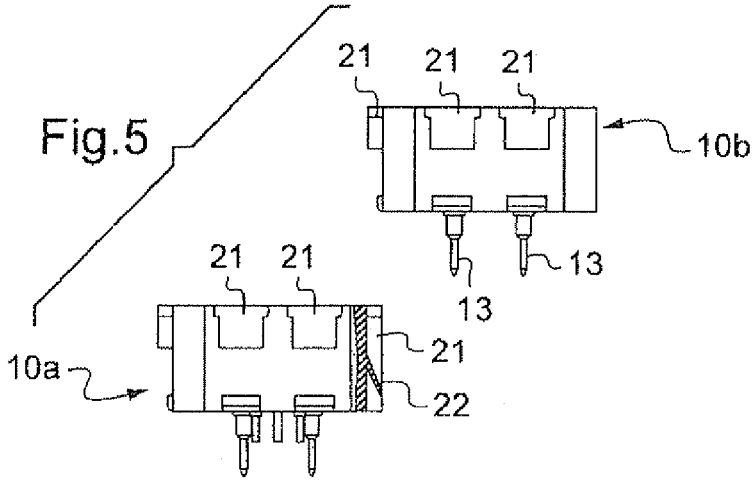

As shown in FIGS. 4 and 5, the units 10*a* and 10*b* are positioned relative to one another in such a manner that the ribs or grooves 21 carried by a side face of a unit 10*a* come respectively into register with the grooves or ribs 21 carried by a side face of a unit 10*b*. Co-operation between these portions in relief may serve to guide and hold the units relative to one another.

Figure 7:
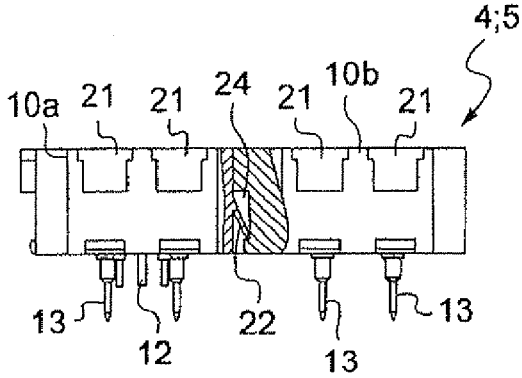

As can be seen in FIGS. 5 and 7, the units may also be held relative to one another by means of the tabs 22 carried by the side surfaces 20 of each of the units 10*a* or 10*b*. Each rib 21 of a first unit is capable of sliding in a groove 21 of a second unit until the tab 22 formed in the groove is actuated and snaps into a cavity 24 provided under the rib 21 of the first unit.

Figure 6:
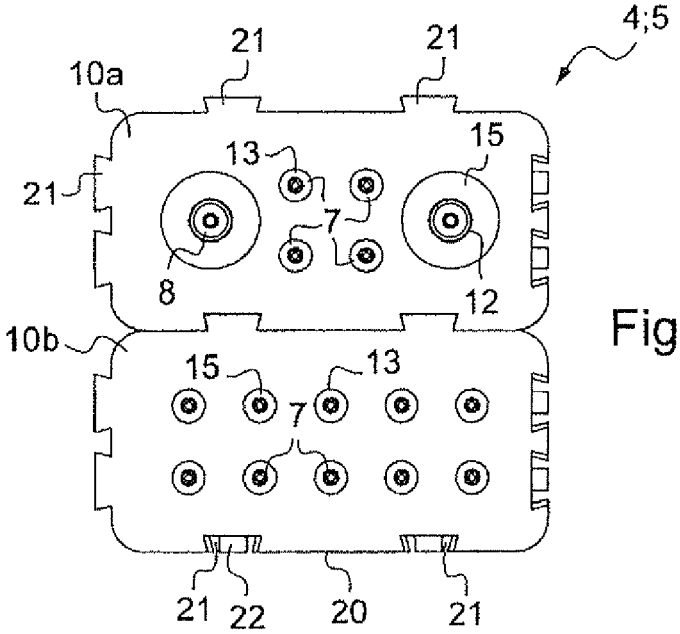
FIGS. 6 and 7 are views from two different directions showing first and second subassemblies obtained from the step shown in FIGS. 4 and 5.

The unit 10*a* shown in FIG. 2 may have the same dimensions as the unit 10*b* shown in FIG. 3, and in particular the same height, thereby enabling the subassembly 4 or 5 that is obtained after assembling a plurality of units 10*a* and 10*b* together to present a height that is uniform. After the units 10*a* and 10*b* have been assembled together, the first subassembly 4 or the second subassembly 5 may be as shown in FIG. 6 or 7.

Figure 8:
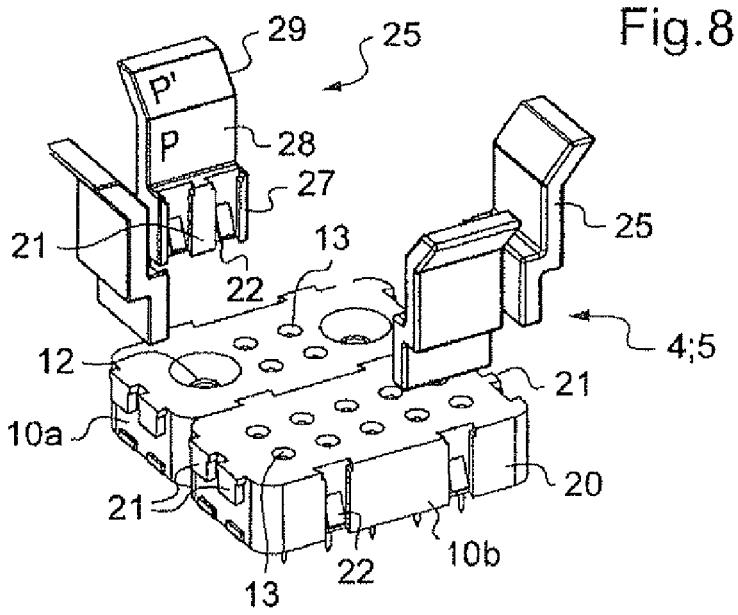
FIG. 8 shows, in isolation, a first subassembly in an embodiment of the invention.

In FIG. 8, it can be seen that the first subassembly 4 and/or the second subassembly 5 may be provided with at least one guide arm 25, and in particular with a plurality of guide arms 25. In the example under consideration, a guide arm is configured to be releasably mounted on the first subassembly 4 or the second subassembly 5. By way of example, this fastening is performed by the above-described portions in relief 21 of the side surfaces 20 of the units 10*a* or 10*b* co-operating with portions in relief of complementary type carried by a guide arm 25.

A plurality of guide arms 25 may be fastened to a single unit 10*a* or 10*b*, e.g. two guide arms 25 per unit. In the example under consideration, the portions in relief enabling a guide arm to be fastened on a unit 10*a* or 10*b* are provided in a fastening part 27 of the guide arm. This fastening part 27 may be surmounted by a part 28 having a smooth surface and extending for the most part in a plane P. This part 28 is surmounted by a top part 29 that extends mainly in a plane P' lying at an angle relative to the plane P in which the part 28 mainly extends.

The guide arms 25 may be mounted on the subassembly 4 or 5 in such a manner that the parts 29 flare away from the subassembly 4 or 5.

The third subassembly 6 is described below in greater detail with reference to FIGS. 9 to 11. In the example under consideration, the third subassembly 6 is made up, like the first and second subassemblies 4 and 5, of various units 30*a* and 30*b*. In similar manner to the above-described unit 10*a*, a unit 30*a* serves to interconnect connectors of different types, while a unit 30*b* serves to interconnect connectors of a single type only. A unit 30*a* thus has two different types of housing 32 and 33, whereas a unit 30*b* has only one type of housing 33. The housings receive connector couplings 35 and 36. In the example described, the housings 32 receive coaxial connector couplings 36 configured to couple together coaxial connectors 17, and the housings 33 receive signal connector couplings 35, e.g. RF or optoelectronic connector couplings that are configured to couple together connectors 18.

Figure 9:
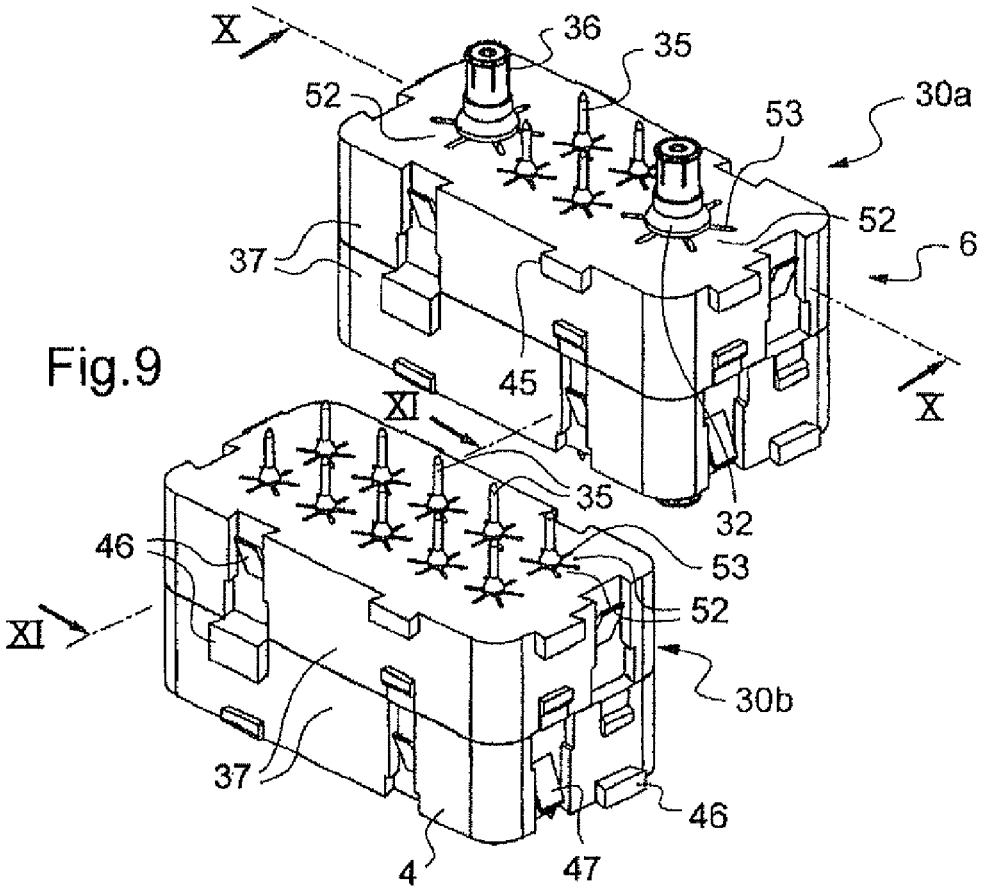
FIG. 9 is a view analogous to FIG. 4 showing units forming the third subassembly in an embodiment of the invention.

As shown in FIG. 9, each unit 30*a* or 30*b* may be made up of shells 37 of complementary shapes, e.g. half-shells. FIGS. 10 and 11 show respectively a section view on X-X of a unit 30*a* shown in FIG. 9 and a section view on XI-XI of a unit 30*b* shown in FIG. 9.

As can be seen, the housings 32 and 33 pass through the units 30*a* and 30*b*. Each of these housings 32 and 33 has two opposite ends defined by respective openings formed in the end walls 40 of the shells 37. Locking means may be provided to hold the shells 37 together so as to form a unit 30*a* or 30*b*. By way of example, these locking means make use of snap-fastening.

As can be seen in FIG. 9, each shell 37 may have a side surface 45 carrying portions in relief 46 and/or tabs 47 to enable two units 30*a* and 30*b* to be connected together, in a manner similar to that described with reference to the side surfaces 20 of the units of the first subassembly 4 or of the second subassembly 5.

Once the first and second shells 37 have been assembled so as to form a unit 30*a* or 30*b*, portions in relief 46 of the first shell may be superposed on portions in relief of complementary type of the second shell 37.

Figure 10:
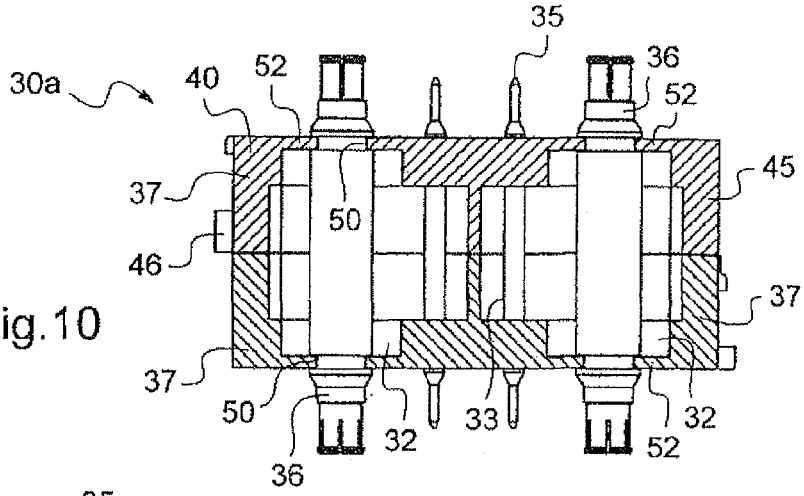
FIG. 10 is a section view on X-X of a unit shown in FIG. 9.

As can be seen in FIGS. 9 and 10, means may be provided for holding the connector couplings 35 or 36 in the housings 32 or 33, and in particular for doing so in non-releasable manner. In the example shown, each coupling 35 or 36 may include in the proximity of each of its portions in relief 50, for example an annular groove in which tabs 52 formed in the end wall 40 of each shell 37 can snap-fasten. The tabs 52 in the example under consideration are separated in pairs by slots 53. The slots 53 may be in a star-shaped pattern.

In examples that are not shown, the tabs 52 may be replaced by a lip extending around all or part of the periphery of the housings 32 or 33.

Once a connector coupling 35 or 36 has been received in a housing 32 or 33, the ends of the coupling may project out from each unit 30*a* or 30*b* of the third subassembly 6.

Figure 11:
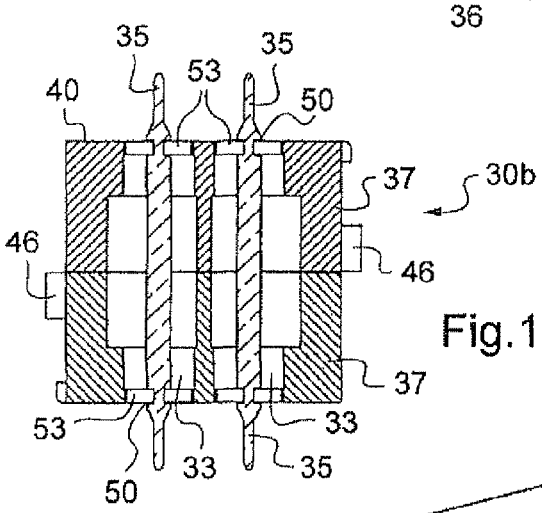
FIG. 11 is a section view on XI-XI of a unit shown in FIG. 9.
Figure 12:
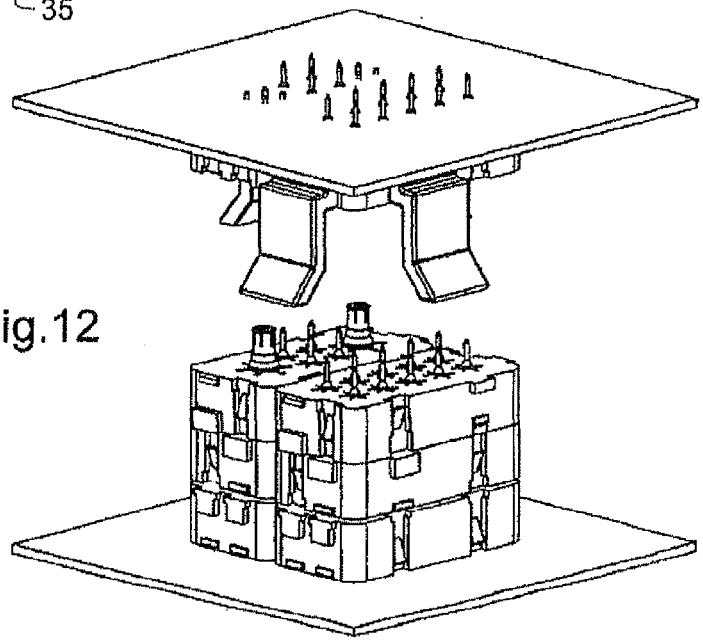
FIG. 12 shows a step of assembling the interconnection system.

With reference to FIGS. 11 and 12, there follows a description of an example method of assembling an interconnection system 1 as described above. In a first step that is not shown each subassembly 4 and 5 is fastened to the respective electronics card 2 or 3, e.g. by soldering. Thereafter, the third subassembly 6 is assembled with the second subassembly 5. During this step, pre-centering of the third subassembly 6 on the second subassembly 5 may be performed in several ways. The portions of the coaxial connector couplings 36 that project from the third subassembly 6 may be guided by the end portions 15 of the housings 12 formed in the units 10*a* and 10*b* of the second subassembly 5. Once pre-centering has been performed, the portions of the signal connector couplings 35 that project from the third subassembly 6, where these couplings 35 are more compact than the coaxial connector couplings 36, may be guided in turn by the end portions 15 of the housings 13 in the units 10*a* and 10*b* of the second subassembly 5.

At the end of this step, the various subassemblies are in the position shown in FIG. 12. Thereafter, the subassemblies 5 and 6 are assembled to the first subassembly 4. During this step, several pre-centering operations may occur, these including pre-centering between the end portions 15 of the housings 12 and 13 in the first subassembly 4 and the portions of the couplings 35 and 36 that project from the third subassembly 6, in a manner similar to that described above for the second and third subassemblies. Additional pre-centering is also provided by the guide arms 25 that come to bear against the side surfaces 20 and 45 of the units of the second subassembly 5 and of the third subassembly 6.

At the end of this step, the interconnection system 1 is as shown in section in FIG. 13. The coupling portions 35 and 36 projecting from the housings in the third subassembly 6 are then received in the housings 12 and 13 in which the connectors 17 and 18 that are connected to the electronics cards 2 and 3 are themselves already arranged.

Although each subassembly comprises only two units in the examples described, the invention is not limited to such an example.

In another example that is not shown, the invention may comprise a plurality of units for each subassembly, each unit being configured to provide interconnections for only one type of connector, with the units differing in their dimensions and/or their numbers of housings.

Although in the example of FIGS. 12 and 13, only the first subassembly 4 is provided with guide arms 25, the second subassembly 5 or the third subassembly 6 could also be provided therewith.

In another variant, during assembly of the interconnection system 1, the third subassembly 6 may initially be assembled with the first subassembly having guide arms, with the resulting assembly then being assembled with the second subassembly that does not have guide arms 25.

FIG. 14 shows a second subassembly 5 and a third subassembly 6 in another embodiment of the invention. In this example, the subassembly 6 comprises two shells 60. By way of example, the shells 60 present dimensions in the planes of the electronics cards 2 and 3 that are greater than or much greater than the dimensions of the shells 37 of the above-described units 10*a* and 10*b*.

In the example of FIG. 14, each shell 60 comprises, by way of example, a plate 62 and two attachment arms 63 projecting from the plate 62. By way of example, each arm is located at an end of the plate 62, and, by way of example, each plate 62 is pierced by a plurality of housings 32 or 33 configured to receive the above-described connector couplings 35 and 36. By way of example, these housings are arranged in a grid.

In the example of FIG. 14, the second subassembly 5 and the first subassembly 4 comprise a single unit that is in the form of a box. At the two ends of the box, there are provided attachment zones 64, which zones 64 serve to co-operate with the attachment arms 63 in order to fasten the shells 60 releasably to the first and second subassemblies 4 and 5. Co-operation between the arms 63 and the zones 64 may also serve to guide the third subassembly 6 relative to the first and second subassemblies during assembly of the system 1, or in a variant they may serve for that purpose only.

Although two attachment and/or guide arms co-operate with two attachment and/or guide zones in the example described, the invention is not limited to one particular number and arrangement of the arms 63 and the zones 64.

In the example of FIG. 14, the housings 12 and 13 formed in the second subassembly 5 are not shown.

Figure 15:
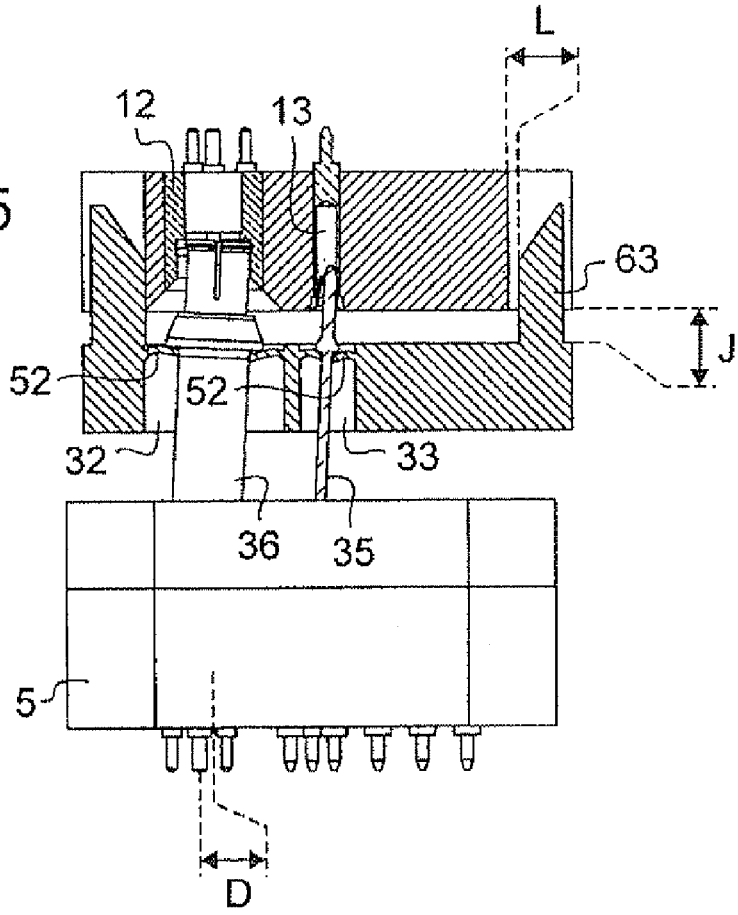
FIG. 15 is a view analogous to FIG. 13 showing an interconnection system in another embodiment of the invention after assembly.

As can be seen in FIG. 15, when a shell 60 is fastened to the first or second subassembly, clearance J may be arranged between the facing surfaces of the shells 60 and the first or second subassembly 4 or 5, the clearance extending in a direction perpendicular to the planes in which the electronics cards 2 and 3 extend. By way of example, this clearance J lies in the range 0 to 3 mm.

Furthermore, the arms 63 may be configured so as to extend around a side wall 68 of each subassembly 4 or 5 with clearance L in a direction parallel to the planes in which the electronics cards 2 and 3 extend.

In the example under consideration, the shells 60 and the third structure 6 are not connected together. There thus exists an empty zone V between the two shells 60, this empty zone V receiving a middle portion of each connector coupling 35 or 36. The total height of the shells 60 is thus less than the height of the third subassembly, for example being less than half the height of the third subassembly.

As shown in FIG. 15, the couplings 35 and 36 may be held in each shell 60 by means of tabs similar to the above-described tabs 52. An interconnection system of the invention as shown in FIG. 15 serves to compensate for misalignment D parallel to the planes in which the electronics cards 2 and 3 extend.

Figure 16:
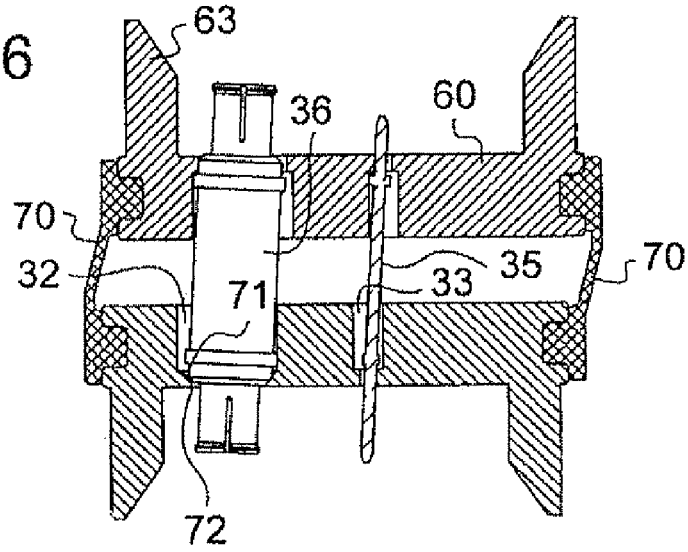
FIG. 16 is a view analogous to FIGS. 10 and 11 showing a third subassembly in another embodiment of the invention.

FIG. 16 shows in isolation a third subassembly 6 in another embodiment of the invention.

This subassembly 6 differs from that of FIGS. 14 and 15 by the fact that the shells 60 are connected together by a connection member, in particular an elastically deformable member 70, which may be made out of rubber for example. This connection member 70 may extend around the entire periphery of the third subassembly 6, or in a variant over a fraction only of the periphery of the third subassembly 6, e.g. in discontinuous manner, in particular in the form of strips.

As shown in FIG. 16, the housings 32 or 33 formed in each shell may present narrowed portions 71 in the proximity of the openings, which narrowed portions have conical inside surfaces, and the connector couplings 35 or 36 may present outside surface portions 72 that are spherical. Reception of the connector couplings 35 or 36 in the housings 32 or 33 can then be facilitated by co-operation between these conical surfaces 71 and these spherical surfaces 72.

The term "comprising a" should be understood as meaning "comprising at least one", unless specified to the contrary.

What is claimed is:

1. An interconnection system for connecting two electronics cards together, wherein the system comprises:

first and second subassemblies including housings each receiving at least one connector, the first and second subassemblies being configured for fastening to first and second electronics cards respectively; and a coupling, third subassembly including housings receiving connector couplings, said connector couplings being configured to couple the connectors of the first subassembly with the connectors of the second subassembly;

the third subassembly being configured to be placed between the first and second subassemblies;

the third subassembly comprising two shells each configured to be fitted on a respective one of the first and second subassemblies; and each shell including attachment means for attaching to one of the first and second subassemblies, each shell and the first and/or second subassembly being configured in such a manner that when a shell is attached to the first or second subassembly, a portion of the shell is arranged around a portion of the first or second subassembly with a clearance in a direction lying in a plane parallel to the planes in which the electronics cards lie.

2. A system according to claim 1, wherein the first and second subassemblies include attachment zones that co-operate with the attachment means to fasten the shells releasably to the first and second subassemblies, this co-operation corresponding solely to the shells of the third subassembly being guided relative to the first or the second subassembly.

3. A system according to claim 1, wherein the connectors comprise connectors of two different types, in particular coaxial connectors and signal connectors.

4. A system according to claim 1, wherein at least one of the first, second, and third subassemblies includes at least one guide arm configured to come into contact with another one of the first, second, and third subassemblies during assembly of the interconnection system.

5. A system according to claim 1, wherein the first, second, and third subassemblies comprise respective pluralities of units configured to be releasably assembled together in order to form the first, second, and third subassemblies respectively.

6. A system according to claim 5, wherein at least one unit includes two to two hundred housings.

7. A system according to claim 5, wherein the first, second, and third subassemblies respectively include at least one unit having housings for receiving connectors or connector couplings of a single type only, and at least one other unit having housings for receiving connectors or connector couplings of a first type and housings for receiving connectors or connector couplings of a second type, different from the first type.

8. A system according to claim 5, wherein the third subassembly comprises units each comprising two shells of complementary shape defining between them, when assembled together, housings receiving connector couplings, each housing being opened at two opposite ends defined by openings formed in the wall of each shell.

9. A system according to claim 1, wherein the shells of the third subassembly are not in contact with each other when the system is assembled.

10. A system according to claim 9, wherein the third subassembly includes connection means for connecting the shell fitted to the first subassembly to the shell fitted to the second subassembly.

11. A system according to claim 10, wherein the connection means are configured to be elastically deformable.

12. A system according to claim 10, wherein the connection means are arranged to hold the shells in a neutral position, i.e. in a position in which the connector couplings are received at right angles in each of the shells, without being in a tilted position.

13. A system according to claim 1, wherein the two electronics cards extend in parallel planes and by the fact that the attachment means of a shell of the third subassembly for attachment to the first or second subassembly are configured in such a manner that the facing surfaces of a shell and of the first or second subassembly on which the shell is attached do not come into contact, a clearance being arranged between said facing surfaces in a direction that is substantially perpendicular to the planes in which the electronics cards extend.

14. A system according to claim 8, wherein the connector couplings and the shells of the third subassembly include means configured for holding at least one of said couplings in at least one of said housings.

15. A system according to claim 13, wherein said means for holding a coupling in a housing comprise at least one portion in relief, in particular an annular groove, formed in the outside surface of the coupling, and tabs formed in the wall of a shell in register with at least one opening defining an end of the housing.

16. A system according to claim 1, wherein each housing of the first and second subassemblies includes an end that is to face the third subassembly when the system is assembled, at least one of said housings including at least one end portion extending from said end towards the inside of said subassembly and presenting a cross-section that tapers going away from said end.

17. A system according to claim 1, wherein the ends of the connectors of the first subassembly placed facing the third subassembly during assembly of the system are of a type different from the ends of the connectors of the second subassembly placed facing the third subassembly during assembly, in particular, the ends of one being of the male type and the ends of the other of the female type, or vice versa.

18. A method of interconnecting two electronics cards using a system according to claim 1, wherein the method comprises the following steps:

fastening the first and second subassemblies to the first and second electronics cards, respectively;

assembling the third subassembly to one of the first and second subassemblies; and assembling the assembly that is obtained at the end of the preceding step to the other one of the first and second subassemblies.

* * * * *